US012404468B2

(12) United States Patent
Bataille Morin et al.

(10) Patent No.: US 12,404,468 B2
(45) Date of Patent: Sep. 2, 2025

(54) ENGINE FUEL BASED ON A MIXTURE OF ALCOHOL AND WATER AND CONTAINING A COMBUSTION IMPROVER ADDITIVE

(71) Applicant: Eurenco France SAS, Sorgues (FR)

(72) Inventors: Anne-Gaëlle Bataille Morin, Bures sur Yvette (FR); Richard Samson, Saran (FR); Fabrice Foucher, Saint Jean le Blanc (FR)

(73) Assignee: Eurenco France SAS, Sorgues (FR)

( * ) Notice: Subject to any disclaimer, the term of this patent is extended or adjusted under 35 U.S.C. 154(b) by 0 days.

(21) Appl. No.: 18/517,601

(22) Filed: Nov. 22, 2023

(65) Prior Publication Data

US 2024/0132793 A1 Apr. 25, 2024

Related U.S. Application Data

(63) Continuation-in-part of application No. 18/119,919, filed on Mar. 10, 2023, now Pat. No. 12,152,209.

(30) Foreign Application Priority Data

Jun. 23, 2022 (FR) ..... 2206260

(51) Int. Cl.

| | |
|---|---|
| ***C10L 1/23*** | (2006.01) |
| ***C10L 1/02*** | (2006.01) |
| ***C10L 1/12*** | (2006.01) |
| ***C10L 1/182*** | (2006.01) |

(52) U.S. Cl.

CPC ..... *C10L 1/231* (2013.01); *C10L 1/02* (2013.01); *C10L 1/125* (2013.01); *C10L 1/1824* (2013.01); *C10L 2230/22* (2013.01)

(58) Field of Classification Search

CPC ..... C10L 1/02; C10L 1/125; C10L 1/1824; C10L 1/231; C10L 2230/22

See application file for complete search history.

(56) References Cited

U.S. PATENT DOCUMENTS 4,177,768 A 12/1979 Davis
4,185,594 A * 1/1980 Perilstein ..... C10L 10/08 44/326
4,248,182 A * 2/1981 Malec ..... C10L 1/18 44/326
4,305,730 A * 12/1981 Davis ..... C10L 1/1883 252/396

(Continued)

FOREIGN PATENT DOCUMENTS

CN 103865592 A 6/2014
CN 104232180 A 12/2014

(Continued)

OTHER PUBLICATIONS

English-language machine translation of DE 3422506 A1 (Year: 1986).*

(Continued)

*Primary Examiner* — James C Goloboy
(74) *Attorney, Agent, or Firm* — Oliff PLC

(57) ABSTRACT

A fuel for a combustion engine includes from about 95.0% to about 99.9% by weight of a liquid water/alcohol mixture, in which water makes up from about 1% to about 15% by weight of the mixture, and from about 0.01% to about 5.0% by weight of an alkyl nitrate.

23 Claims, 4 Drawing Sheets

(56) References Cited

U.S. PATENT DOCUMENTS

| | | | | |
|---|---|---|---|---|
| 4,801,305 | A * | 1/1989 | Muller | C10L 1/023 44/451 |
| 2006/0156619 | A1 | 7/2006 | Crawshaw et al. | |
| 2008/0086935 | A1* | 4/2008 | Cunningham | C10L 1/143 44/418 |
| 2017/0121621 | A1* | 5/2017 | Fabre | C10L 1/10 |
| 2018/0179967 | A1* | 6/2018 | Jennings | F02M 37/0064 |

FOREIGN PATENT DOCUMENTS

| | | | | |
|---|---|---|---|---|
| CN | 108587696 | A | 9/2018 | |
| CN | 110317645 | A | 10/2019 | |
| CN | 214944586 | U | 11/2021 | |
| CN | 114561234 | A | 5/2022 | |
| DE | 27 01 588 | A1 | 7/1978 | |
| DE | 2701588 | A * | 7/1978 | C10L 1/00 |
| DE | 3422506 | A * | 2/1986 | C10L 1/02 |
| EP | 0 030 429 | A2 | 6/1981 | |
| EP | 0 116 197 | A2 | 8/1984 | |
| EP | 1674553 | A1 | 6/2006 | |

OTHER PUBLICATIONS

May 24, 2024 U.S. Office Action issued in U.S. Appl. No. 18/119,919.

Dempsey, A.B., Walker, N.R., Reitz, R., "Effect of Cetane Improvers on Gasoline, Ethanol, and Methanol Reactivity and the Implications for RCCI Combustion", SAE Int. J. Fuels Lubr., 2013, 6(1), 170-187 (Year: 2013).

Stein et al., "The Autoignitiion Behavior of Surrogate Diesel Fuel Mixtures and the Chemical Effects of 2-Ethylhexyl Nitrate (2-EHN) Cetane Improver," Society of Automotive Engineers, Inc., 1999, pp. 1029-1045.

Liu, H., Zhang, X., Zhang, Z., Wu, Y., Wang, C., Chang, W., Zheng, Z., Yao, M., "Effects of 2-ethylhexyl nitrate (EHN) on combustion and emissions on a compression ignition engine fueling high-pressure direct-injection pure methanol fuel", Fuel, 2023, 127684 (Year: 2023).

Jan. 8, 2024 Office Action Issued in U.S. Appl. No. 18/119,919.

* cited by examiner

ENGINE FUEL BASED ON A MIXTURE OF ALCOHOL AND WATER AND CONTAINING A COMBUSTION IMPROVER ADDITIVE

FIELD OF THE INVENTION

The field of the invention is that of fuels for combustion engines. The fuel of the invention belongs to the new fuels with reduced environmental impact, for example those commonly called "e-fuels" when they are made from low-carbon electricity, low-carbon hydrogen, and/or from $CO_2$. They are considered a solution for the decarbonisation of transportation. The fuel of the invention is essentially (for at least 98%) composed of methanol, or is essentially composed of a water/alcohol mixture and is thus part of the ecological alternatives for the replacement of fossil fuels. In the latter case, water represents up to 15% by weight of the mixture. The function of water is to reduce the production of nitrogen oxides in the engine's combustion products. Alcohol is therefore the main component of the fuel. The invention relates to an additive which, when incorporated into the water/alcohol mixture, ensures better ignition and faster combustion of the fuel in the engine.

STATE OF THE ART

Methanol of the "e-fuels" type represents a credible low environmental impact alternative to replace fossil fuels and biofuels for combustion engines in the near future. The combustion of methanol thus produced leads to a neutral $CO_2$ balance. Methanol as a fuel has a usable energy density in combustion engines but has a low cetane number. Its ignition in compression ignition engines, such as diesel, is problematic especially at low engine speeds. Different ways to improve the ignition of methanol in a compression ignition engine have been described.

The first means is the co-injection of a pilot fuel or additive with methanol into the engine. For example, patent application CN 214944586 describes the co-injection of a diesel-type pilot fuel with methanol as the primary fuel. The scientific article "Effect of Cetane Improvers on Gasoline, Ethanol, and Methanol Reactivity and the Implications for RCCI Combustion" (SAE International Journal of Fuels and Lubricants Vol. 6, No. 1 (April 2013), pp. 170-187) describes the co-injection of 2-ethylhexyl nitrate (EHN) with a fuel consisting primarily of methanol in the gaseous state. During combustion in a specific RCCI (Reactivity Compression Controlled Ignition) mode, a well-mixed fuel and low-reactivity oxidizer (usually with air) are compressed in the gaseous state but do not reach self-ignition. Later, still during the compression cycle, high reactivity fuel, in this case EHN, is injected to form a local mixture of low and high reactivity fuel. A EHN weight ratio of 7% co-injected in the presence of gaseous methanol is said to lead to acceptable combustion efficiency compared with a reference fuel consisting of a mixture of isooctane and n-heptane. This type of process has the major disadvantage of requiring co-injection control according to the engine's operating conditions, structural arrangements such as separate tanks and injection systems. Also, the use of a fuel oil as a pilot fuel generates $CO_2$ emissions with a negative impact on the environment.

The second means is a mixture of fuels with methanol. It is known that alcohols, such as methanol or ethanol, can be mixed in a minority or majority proportion with fossil or synthetic diesel fuels such as dimethyl ether (DME) or with gasoline. In this case again the $CO_2$ emission balance is negative for the environment.

The third means is the incorporation of an ignition improvement additive in admixture with methanol, possibly also in admixture with diesel fuel. Numerous patent applications, such as CN 103865592 and CN 104232180, describe the incorporation of a cocktail of multifunctional additives in a mixture with methanol, possibly also in a mixture with a fuel oil. These additives have, for example, conservation, anti-corrosion, combustion improvement and detergency functions. These additives generally represent at least 10% of the weight of the fuel. The proportion of methanol in the fuel is between 30% and 90% by weight depending on the weight percentages of additives and diesel fuel present in the fuel. The combined effects of these additives are only observed in a global way without dosing with precision the necessary quantities. It is therefore not a fuel essentially composed of methanol.

It is moreover known to mix fuels such as diesel, biodiesel and/or alcohol with water (typically up to 15% by weight) to reduce the production of nitrogen oxides in the combustion products of compression or spark ignition engines. However, the addition of water reduces the combustion temperature and flammability of the fuel. U.S. Pat. No. 7,216,607 and the scientific paper "Performance and NOx Emissions of Spark Ignited Combustion Engines Using Alternative Fuels-Quasi One-Dimensional Modeling II. Methanol Fueled Engine" (Combustion Science and Technology Volume 18, 1978—Issue 5-6) describe these effects of adding water to fuels.

On another level, in the field of hydrocarbon diesel or bio-diesel fuels, 2-ethylhexyl nitrate (EHN) has long been known to be used as a cetane enhancer in diesel fuel. A higher cetane value ensures lower fuel consumption, reduced particulate matter and NOx emissions, faster cold engine start, reduced engine knock and noise, and reduced engine wear. The reaction mechanism of EHN in the presence of a hydrocarbon diesel fuel has been studied for example in the scientific publication "The Autoignition Behavior of Surrogate Diesel Fuel Mixtures and the Chemical Effects of 2-Ethylhexyl Nitrate (2-EHN) Cetane Improver" (vol. 108, section 4: Journal of fuels and lubricants (1999), pp. 1029-1045). However, the reaction mechanism of its diesel fuel cetane improver effect is still poorly understood and its use is based on empirical laws. For this reason, its effectiveness on fuels other than diesel cannot be presumed. This additive is industrially produced and widely used in commercial diesel fuels. More than fifty thousand tons of EHN have been produced per year in Europe since the 1980s. Other alkyl nitrates can also be used as cetane enhancement additives in diesel fuel.

The present invention provides a solution for improving the ignition methanol in combustion engines, as well as the ignition of a fuel essentially consisting of a water/alcohol mixture in combustion engines. This improvement is obtained by adding the EHN additive alone in a small proportion by weight to methanol or the water/alcohol mixture. More broadly, other alkyl nitrates, known to have cetane number improving properties similar to EHN for diesel fuel, are also advocated in the context of the present invention for improving the ignition of methanol or the water/alcohol mixture. It is unexpected that additives known to increase the cetane number of a diesel or biodiesel hydrocarbon can be so effectively used, at very low weight percentages, to improve the ignition of an alcohol, such as methanol, alone or in admixture with water.

SUMMARY OF THE INVENTION

The invention relates to a fuel comprising from about 98.0% to about 99.9% by weight of methanol for a combustion engine of the compression-ignition or spark-ignition type, and from about 0.01% to about 2.0% by weight of a compound for improving the ignition delay of methanol.

The invention also relates to a liquid fuel for a combustion engine of the compression-ignition or spark-ignition type, comprising from about 95.0% to about 99.9% by weight of a water/alcohol mixture and from about 0.01% to about 5.0% by weight of a compound for improving the ignition delay of the fuel, the water/alcohol mixture consisting of from about 1% to about 15% by weight of water and from about 85% to about 99% by weight of alcohol.

The compound for improving the ignition delay of the fuel (methanol or water/alcohol mixture) is an alkyl nitrate, which is liquid at room temperature, has low flammability, and is non-toxic and industrially produced.

The said compound, at these low levels in the presence of methanol or the water/alcohol mixture, is therefore conventionally assimilated to a fuel additive.

The addition of said liquid compound to methanol or the water/alcohol mixture is carried out in the liquid state to form the fuel according to the invention in a tank. It can also be stored separately and mixed with methanol or the water/alcohol mixture to form the fuel according to the invention prior to its injection into the engine, or co-injected to form the fuel according to the invention in a premix chamber of the engine.

The said compound, of the alkyl nitrate type, previously reserved for improving the cetane number of fossil diesel or biodiesel hydrocarbon fuels, is thus used effectively and surprisingly as an additive for improving the ignition of methanol and the alcohol in admixture with water.

DESCRIPTION OF THE INVENTION

Figure 1:
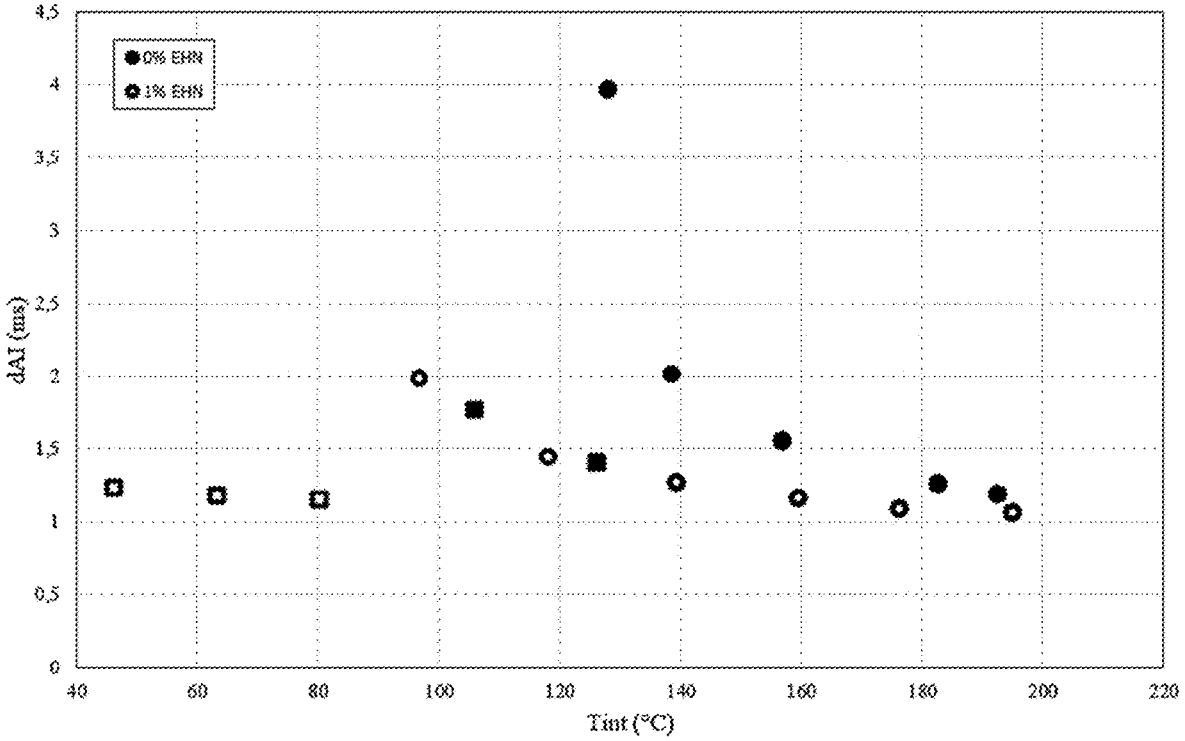
FIG. 1 shows the effect of EHN on the ignition delay of a water/methanol mixture, water making up 5 wt % of the mixture, with a single main injection (circular dots on figure) or a micro-injection followed by a main injection (square dots on figure) into the engine cylinder.

As defined herein, "alcohol" is understood to mean an alcohol having from 1 to 4 carbon atoms. In some embodiments, the alcohol is methanol or ethanol, advantageously methanol.

In one aspect, the present disclosure relates to a fuel for combustion engines which comprises about 98.0% to about 99.9% by weight of methanol and about 0.01% to about 2.0% by weight of an alkyl nitrate. In some embodiments, the fuel comprises about 0.05% to about 1.5% by weight of alkyl nitrate. In some embodiments, the fuel comprises about 0.1% to about 1.0% by weight of alkyl nitrate. In some embodiments, the fuel comprises about 0.1% to less than 1.0% (<0.1%) by weight of alkyl nitrate.

In another aspect, the present disclosure relates to a fuel for combustion engines, of the compression-ignition or spark-ignition type, which comprises from about 98.0% to about 99.9% by weight of a water/alcohol mixture, wherein water makes up from about 1.0% by weight to about 15.0% by weight of the mixture, and from about 0.01% to about 5.0% by weight of an alkyl nitrate. In some embodiments, the fuel comprises about 1.0% to about 3.0% by weight of alkyl nitrate.

In some embodiments, the fuel of the invention consists of the water/alcohol mixture and the alkyl nitrate (in which case the amount of alkyl nitrate in the fuel is of at least 0.1% by weight).

In some embodiments, when the sum of the amount of the water/alcohol mixture and the amount of alkyl nitrate is not equal to 100% by weight, the fuel may contain one or more other additives to make the fuel 100% complete, such as additives with preservative, anti-corrosion or detergent functions.

The alkyl nitrate, which is added to the water/alcohol mixture, is more particularly selected from linear alkyl nitrates having 4 to 36, advantageously 4 to 24 carbon atoms, branched alkyl nitrates having 4 to 36, advantageously 4 to 24 carbon atoms, cyclic alkyl nitrates (or cycloalkyl nitrate) having 5 to 18 carbon atoms, and mixtures thereof. In some embodiments, the alkyl nitrate is selected from hexyl nitrate, cyclohexyl nitrate, 2-ethylhexyl nitrate, 2-octyl nitrate, n-nonyl nitrate, isononyl nitrate, dodecyl nitrate, 2-propylheptyl nitrate, 2-tetradecyl-1-octadecyl nitrate, a mixture of $C_9$ to $C_{13}$ branched alkyl nitrates, and mixtures thereof. In some embodiments, the alkyl nitrate is 2-ethylhexyl nitrate alone or in admixture with one or more other alkyl nitrates as defined above, advantageously the alkyl nitrate is 2-ethylhexyl nitrate.

Mixtures of $C_9$ to $C_{13}$ branched alkyl nitrates can be synthesized from the corresponding mixtures of branched $C_9$ to $C_{13}$ alcohols, for example from the alcohols available under the tradename Exxal™ from Exxon. As an example, a mixture of at least two branched alcohols selected from a $C_9$ branched alcohol, a $C_{10}$ branched alcohol, a $C_{11}$ branched alcohol, a $C_{12}$ branched alcohol and a $C_{13}$ branched alcohol can be prepared and then the corresponding mixture of alkyl nitrates can be synthesized.

According to some embodiments, the alkyl nitrate is mixed in the liquid state with +the water/alcohol mixture in the tank supplying the engine, to obtain the liquid fuel according to the invention.

According to some embodiments, the alkyl nitrate on the one hand and methanol or the water/alcohol mixture on the other hand, are stored separately, and brought together in the liquid state in an injector, thereby forming the liquid fuel according to the invention before it is fed into the combustion chamber of the engine.

According to some embodiments, the alkyl nitrate is stored separately from methanol or the water/alcohol mixture and is co-injected with methanol or the water/alcohol mixture to form the liquid fuel according to the invention in a premix chamber of the engine.

The present disclosure also relates to the use of an alkyl nitrate (as defined above), in the amounts defined above, as an ignition improver for a fuel based on (or consisting of) methanol or a water/alcohol mixture.

The present disclosure also relates to a method for improving the ignition of a fuel based on (or consisting of) methanol or a water/alcohol mixture in an engine, such as a combustion engine, the method comprising adding an alkyl nitrate (as defined above) to methanol or the water/alcohol mixture, in the amounts defined above. In some embodiments, the alkyl nitrate and methanol or the water/alcohol mixture are mixed in an injector. In some embodiments, the alkyl nitrate and methanol or the water/alcohol mixture are mixed in a premix chamber of the engine.

The present disclosure also relates to an engine, such as a combustion engine, of a motorized vehicle (such as a car, truck, tractor, etc.), or motorized vessel (such as a tanker, container ship, etc.) containing a fuel as defined above. The present disclosure also relates to a motorized vehicle or vessel comprising an engine as defined above.

The present disclosure is illustrated by the following examples given for information purposes.

EXAMPLES

The performance of the fuel according to the invention compared with a fuel composed solely of methanol and water was measured using an experimental laboratory compression ignition, single-cylinder, 0.499 L direct injection engine, targeting a mean indicated pressure (MIP) of 3 Bars at 1500 rpm. After passing 100 cycles (necessary for future calculations to obtain a consistent average of values), the values of the engine's operating parameters were measured. At the same time, it was possible to record 20 pollutant measurement cycles, each 5 seconds apart, to obtain a representative average of emissions from different cycles. From the values recovered above, the following parameters characterizing fuel combustion and engine operation were extracted:

dAI auto-ignition delay (ms),
Mean Indicated Pressure (MIP)
MIP Covariance (COVMIP),
CA1 angle,
CA50 angle,
combustion time,
pollutants (NOx, CO, $H_2O$, HC),
heat release rate.

The addition of the alkyl nitrate to the water/methanol mixture improved the overall combustion and engine operating parameters, compared with a fuel consisting solely of a water/methanol mixture. The performance of the fuel of the invention could be further improved by controlling fuel injection with multiple injections at each engine cycle, for example with one or more so-called pilot micro-injections followed by a main injection.

The ignition delay as a function of the fuel intake temperature is the value resulting from the tests, which is presented below to illustrate the advantages of the invention.

The ignition delay dAI is defined according to the following formula in which Pc is the pressure applied to the injected fuel:

$$dAI = t\left(\frac{dP}{dt_{max}}\right) - t(P_c)$$

Example 1

This example concerns the improvement, by addition of EHN, of the combustion performance in an engine of a mixture consisting of 95% by weight of methanol and 5% by weight of water.

The ignition delays were determined as a function of the intake temperature (from 313K to 473K—40° C. to 200° C.), at a pressure Pc of 300 bar, of a fuel according to the invention consisting of 99.0% by weight of a water/methanol mixture, water making up 5.0% by weight of the mixture, and 1.0% by weight of EHN and for a richness of the mixture with air of 0.25. The results are shown in FIG. 1 with the ignition delay benchmarks of the water/methanol (5 wt %/95 wt %) mixture alone. It can be seen from FIG. 1 that there is a significant reduction in fuel ignition delays when the fuel contains EHN, compared to the fuel without EHN. This reduction in ignition delay is all the more important that the temperature is low.

For operation with a single main injection, at an admission temperature of 403 K, the ignition delay of the fuel of the invention according to the present example was approximately 3 times less than that of the reference fuel comprising only a water/methanol mixture. The fuel of the invention ignited even at low intake temperatures below 403K, down to 373K with an ignition delay of 2 ms, for which the water/methanol mixture did not ignite.

Under multiple injection conditions involving a micro-injection (lasting 400 μs at a crankshaft angle of −25°) followed by a main injection (lasting 1,500 μs at a crankshaft angle of −15°), an improvement was observed in the combustion characteristics of the methanol/water mixture, which ignited at 373 K with an ignition delay of about 1.75 ms. Combustion of the water/methanol mixture under these conditions and at this temperature was close to that of the water/methanol mixture containing 1.0 wt % of EHN, but operated with a single main injection. Below 373 K, the water/methanol mixture did not ignite. In contrast, the water/methanol mixture containing 1.0 wt % of EHN did ignite at temperatures as low as 313 K, with an ignition delay of about 1.2 ms.

Example 2

This example relates to the performance improvement, by addition of EHN, of the in-engine combustion of a mixture consisting of 90% by weight of methanol and 10% by weight of water.

Figure 2:
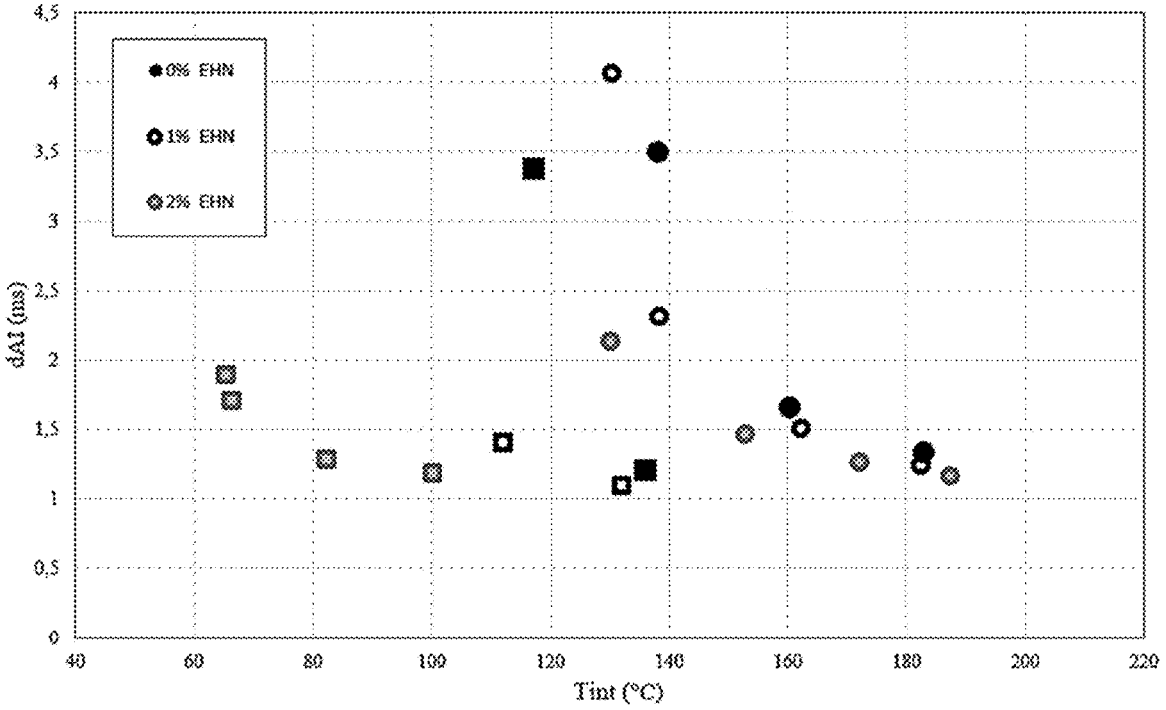
FIG. 2 shows the effect of EHN on the ignition delay of a water/methanol mixture, water making up 10 wt % of the mixture, with a single main injection (circular dots on figure) or a micro-injection followed by a main injection (square dots on figure) into the engine cylinder.

Ignition delays were determined as a function of the intake temperature (from 313K to 463K), at a pressure Pc of 300 bar, for a fuel according to the invention consisting of 98% by weight of a water/methanol mixture, with water making up 10% by weight of the mixture, and 2% by weight EHN and for a richness of the mixture with air of 0.25. The results are shown in FIG. 2 with the ignition delay reference points for the water/methanol mixture alone. For an addition of 1% by weight of EHN, an improved fuel combustion performance was observed for intake temperatures below 433K. For an intake temperature of 413K, the fuel containing 1% by weight of EHN had an ignition delay approximately 1.5 times lower than that of the water/methanol reference fuel. At an intake temperature of 413K with 2% by weight of EHN, the ignition delay was twice lower than that of the water/methanol mixture. At an intake temperature of 403K, the water/methanol mixture did not ignite, whereas fuels containing 1% by weight of EHN and 2% by weight of EHN ignited with a delay of about 4 ms and 2.2 ms, respectively.

Under multiple injection conditions, with a micro-injection (lasting 400 μs at a crankshaft angle of −25°) followed by a main injection (lasting 1500 μs at a crankshaft angle of −15°), an improvement in the combustion characteristics of the water/methanol mixture was observed, which mixture ignited at 393K with an ignition delay of around 3.5 ms. Below 393K, the water/methanol mixture did not ignite. In contrast, fuel containing 1% by weight of EHN ignited at temperatures as low as 383K with an ignition delay of around 1.5 ms. Fuel containing 2% by weight of EHN ignited up to 333K with an ignition delay of about 1.75 ms.

The results of Examples 1 and 2 are summarized in Table 1.

TABLE 1

| Water/ MeOH (wt %) | EHN (wt %) | Single injection | Micro-injection followed by main injection | Minimum ignition temperature (K/° C.) | Ignition delay (ms) |
|---|---|---|---|---|---|
| 5%/95% | 0 | X | | 403 (130) | 4 |
| | 1% | X | | 373 (100) | 2 |
| | 0 | | X | 373 (100) | 1.75 |
| | 1% | | X | 313 (40) | 1.25 |
| 10%/90% | 0 | X | | 413 (140) | 3.5 |
| | 1% | X | | 403 (130) | 4 |
| | 2% | X | | 403 (130) | 2.2 |
| | 0 | | X | 393 (120) | 3.5 |
| | 1% | | X | 383 (110) | 1.5 |
| | 2% | | X | 333 (60) | 1.75 |

These examples show that the use of alkyl nitrate in a low weight percentage can significantly improve the ignition delay of a water/alcohol-based fuel. More generally, the addition of an alkyl nitrate-type compound to a water/alcohol mixture improves overall fuel performance in a combustion engine, while maintaining limited emissions of nitrogen oxides, up to intake temperatures close to ambient temperature. There was no reason to believe that additives known to increase the cetane number of a diesel or biodiesel hydrocarbon could be used so effectively, in very small quantities, to improve the ignition of a water/alcohol mixture.

In the following examples, the ignition delay improvement of methanol was measured under test conditions equivalent to those described in the scientific paper "Ignition delay times of $NH_3$/DME blends at high pressure and low DME fraction: RCM experiments and simulations" (Combustion and Flame Volume 227, May 2021, Pages 120-134). The test laboratory engine is a fast compression machine equivalent to the one described in this scientific paper. This is a fast compression machine for measuring the auto-ignition time of a mixture. This machine allows compressing in a very short time the mixture in order to obtain preset pressure and temperature conditions. The liquids are admitted into the tank through a different orifice than the gas inlet. The liquid quantities are measured with a syringe and a precision balance.

Example 3

Figure 3:
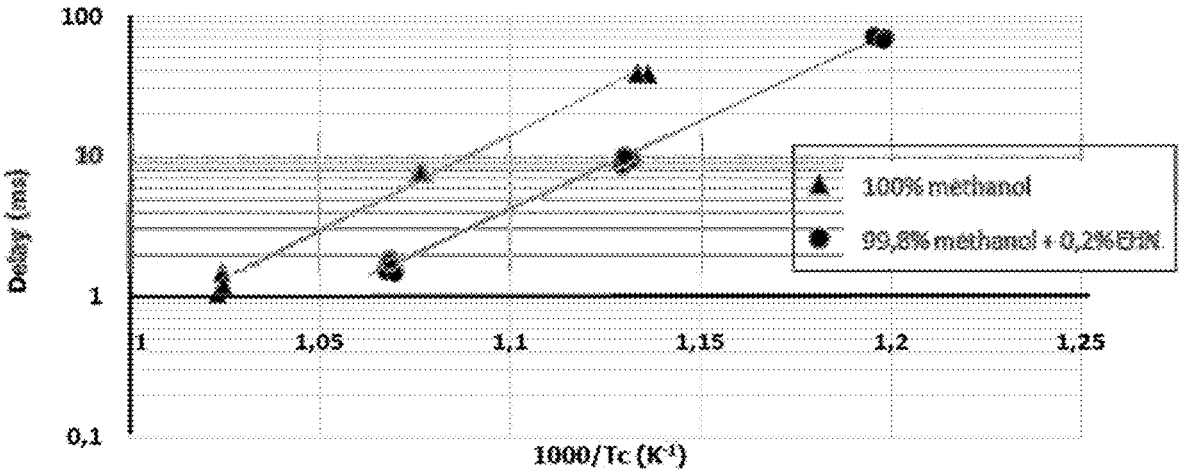
FIGS. 3 to 6 show the ignition delay of fuels containing methanol alone or in admixture with EHN over a range of injection temperatures.
Figure 4:
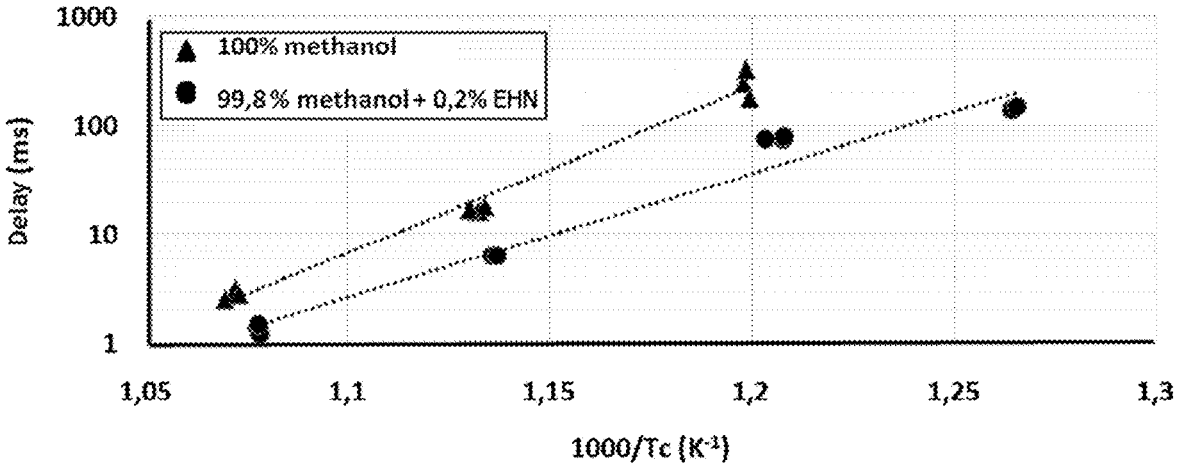
Figure 5:
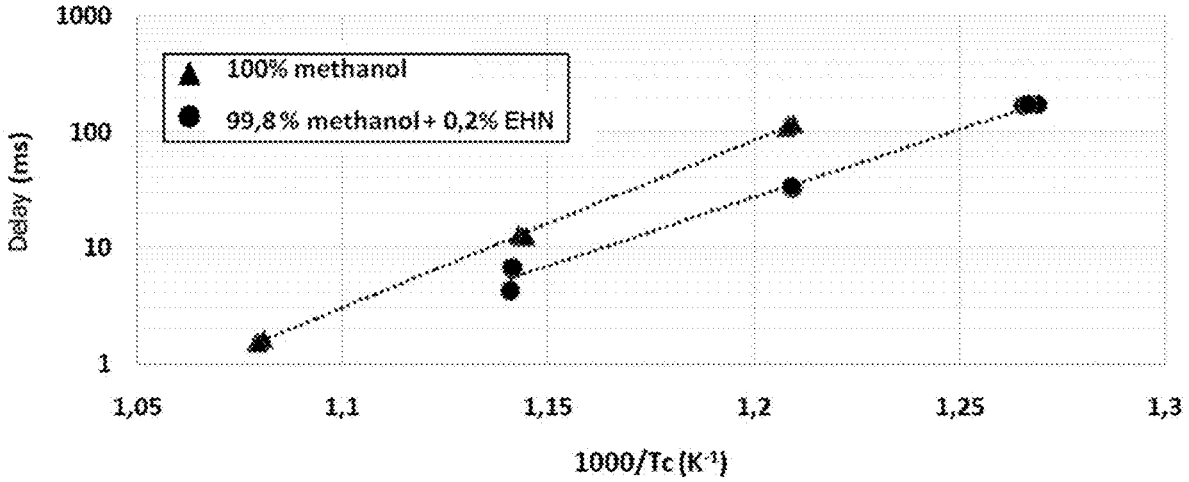

The ignition delays were determined as a function of the injection temperature (between 800K and 1000K), at a pressure Pc of 30 bar, of a fuel according to the invention consisting of 99.8% by mass of methanol and 0.2% by mass of EHN and for a richness of 0.5, 1 and 1.5 of mixture with air respectively. The results are shown in FIGS. 3, 4, and 5 with the ignition delay benchmarks of methanol alone. There is a significant reduction, approximately by a factor of 5 to 10, in fuel ignition delay when the fuel contains EHN, compared to methanol alone. This reduction in ignition delay compared to methanol alone is all the more important that the temperature is low.

Example 4

Figure 6:
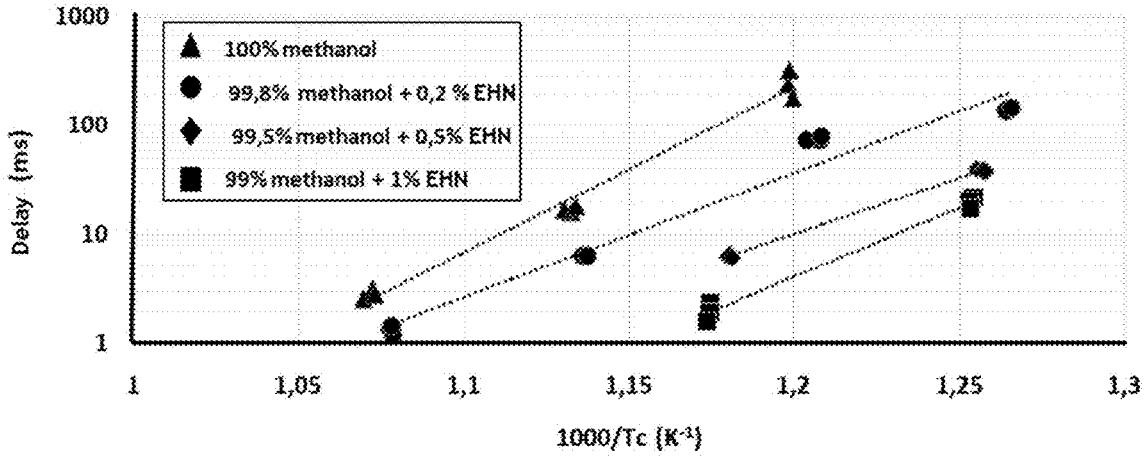
Figure 7:
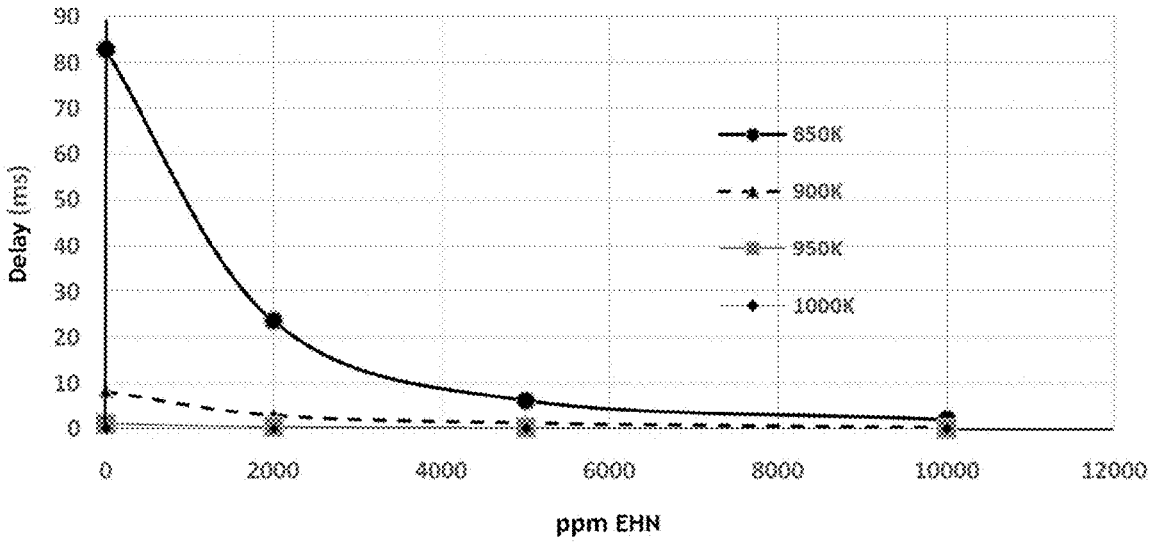
FIGS. 7 and 8 show the ignition delays of methanol-based fuels at different injection temperature as a function of the amount of EHN present in the fuels.
Figure 8:
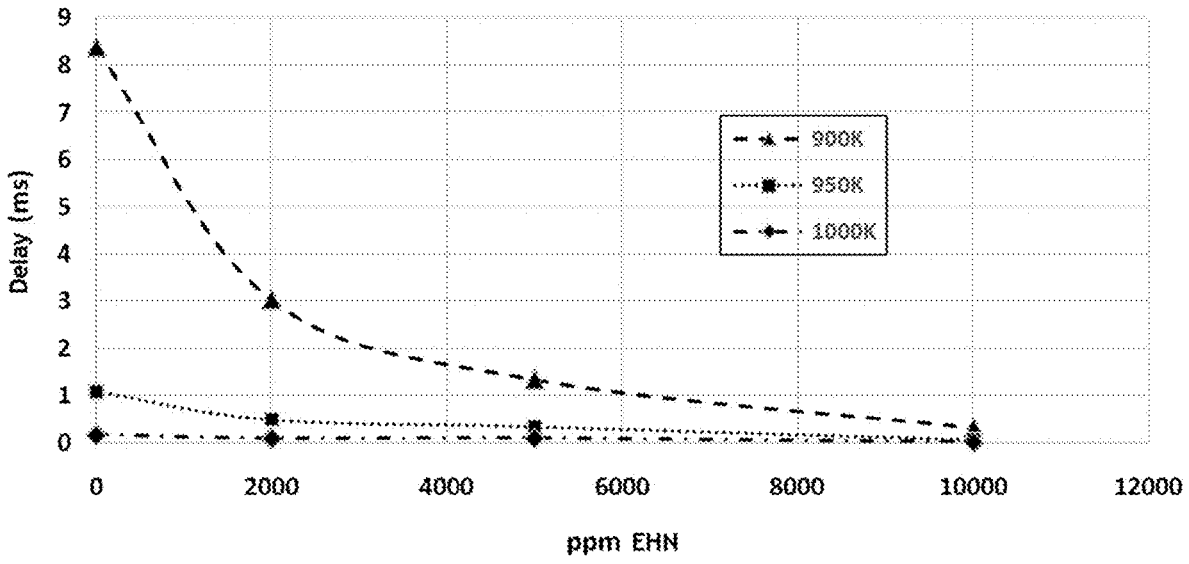

The ignition delays of different fuels containing either methanol alone or a mixture of methanol and EHN at 0.2%, 0.5% or 1% by weight, at different injection temperatures (temperature range 790K to 1000K), at a pressure Pc of 30 bar and a mixture richness of 1 with air, were determined. As can be seen in FIGS. 6 to 8, the addition of EHN to a methanol fuel results in a significant decrease in ignition delay compared to methanol alone.

These examples show that the use of alkyl nitrate(s) in a very low weight percentage can significantly improve the ignition delay of a methanol-based fuel. There was no reason to believe that additives known to increase the cetane number of a diesel or biodiesel hydrocarbon could be used so effectively, in very small quantities, to improve the ignition of an alcohol like methanol.

Although the presently disclosed subject matter and its advantages have been described in detail, it should be understood that various changes, substitutions and alterations can be made herein without departing from the spirit and scope of the application as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the presently disclosed subject matter, processes, machines, manufacture, compositions of matter, means, methods, or steps, presently existing or later to be developed that perform substantially the same function or achieve substantially the same result as the corresponding embodiments described herein can be utilized according to the presently disclosed subject matter. Accordingly, the appended claims are intended to include within their scope such processes, machines, manufacture, compositions of matter, means, methods, or steps.

In addition to the various embodiments depicted and claimed, the disclosed subject matter is also directed to other embodiments having any other possible combination of the features disclosed and claimed herein. As such, the particular features presented herein can be combined with each other in other manners within the scope of the disclosed subject matter such that the disclosed subject matter includes any suitable combination of the features disclosed herein. Thus, the foregoing description of specific embodiments of the disclosed subject matter has been presented for purposes of illustration and description. It is not intended to be exhaustive or to limit the disclosed subject matter to those embodiments disclosed.

It will be apparent to those skilled in the art that various modifications and variations can be made in the composition, device, and method of the disclosed subject matter without departing from the spirit or scope of the disclosed subject matter. Thus, it is intended that the disclosed subject matter include modifications and variations that are within the scope of the appended claims and their equivalents.

For any patents, patent applications, publications, product descriptions, and protocols are cited throughout this application, the disclosures of all of which are incorporated herein by reference in their entireties for all purposes.

What is claimed is:

1. A fuel for a combustion engine, consisting of:

(a) from about 95.0% to about 99.9% by weight of a liquid water/alcohol mixture, in which water makes up from about 1% to about 15% by weight of the mixture, and (b) from about 0.01% to about 5.0% by weight of an alkyl nitrate.

2. The fuel of claim 1, consisting of from about 97.0% to about 99.9% by weight of said water/alcohol mixture, and from about 0.1% to about 3.0% by weight of said alkyl nitrate.

3. The fuel of claim 1, wherein the alkyl nitrate is selected from the group consisting of a nitrate of a linear alkyl having from 4 to 36 carbon atoms, a nitrate of a branched alkyl having from 4 to 36 carbon atoms, a nitrate of a cyclic alkyl having from 5 to 18 carbon atoms, and mixtures thereof.

4. The fuel of claim 1, wherein the alkyl nitrate is selected from the group consisting of hexyl nitrate, cyclohexyl nitrate, 2-ethylhexyl nitrate, 2-octyl nitrate, n-nonyl nitrate, isononyl nitrate, dodecyl nitrate, 2-propylheptyl nitrate, 2-tetradecyl-1-octadecyl nitrate, a mixture of C9 to C13 branched alkyl nitrates, and mixtures thereof.

5. The fuel of claim 4, wherein the alkyl nitrate is 2-ethylhexyl nitrate.

6. The fuel of claim 1, wherein the alcohol is methanol or ethanol.

7. The fuel of claim 6, wherein the alcohol is methanol.

8. A method of obtaining a fuel according to claim 1, which consists of mixing, in a liquid state, an alkyl nitrate with a water/alcohol mixture.

9. The method of claim 8, wherein the water/alcohol mixture and the alkyl nitrate are mixed in an engine tank.

10. The method of claim 8, wherein the water/alcohol mixture and the alkyl nitrate are mixed in an injector.

11. The method of claim 8, wherein the water/alcohol mixture and the alkyl nitrate are mixed in a premix chamber of an engine.

12. A method for improving the ignition, in a combustion engine, of a fuel initially consisting of a liquid water/alcohol mixture, in which water makes up from about 1% to about 15% by weight of the mixture, the method consisting of adding to the said mixture an alkyl nitrate, in an amount such as to provide a final fuel composition consisting of:

(a) from about 95.0% to about 99.9% by weight of a liquid water/alcohol mixture, in which water makes up from about 1% to about 15% by weight of the mixture, and (b) from about 0.1% to about 5.0% by weight of an alkyl nitrate.

13. The method of claim 12, wherein the alkyl nitrate is selected from the group consisting of a nitrate of a linear alkyl having from 4 to 36 carbon atoms, a nitrate of a branched alkyl having from 4 to 36 carbon atoms, a nitrate of a cyclic alkyl having from 5 to 18 carbon atoms, and mixtures thereof.

14. The method of claim 12, wherein the alkyl nitrate is selected from the group consisting of hexyl nitrate, cyclohexyl nitrate, 2-ethylhexyl nitrate, 2-octyl nitrate, n-nonyl nitrate, isononyl nitrate, dodecyl nitrate, 2-propylheptyl nitrate, 2-tetradecyl-1-octadecyl nitrate, a mixture of C9 to C13 branched alkyl nitrates, and mixtures thereof.

15. The method of claim 14, wherein the alkyl nitrate is 2-ethylhexyl nitrate.

16. The method of claim 12, wherein the alcohol is methanol or ethanol.

17. The method of claim 16, wherein the alcohol is methanol.

18. The method of claim 12, wherein the water/alcohol mixture and the alkyl nitrate are mixed in a tank of the engine.

19. The method of claim 12, wherein the water/alcohol mixture and the alkyl nitrate are mixed in an injector.

20. The method of claim 12, wherein the water/alcohol mixture and the alkyl nitrate are mixed in a premix chamber of the engine.

21. An engine containing the fuel of claim 1.

22. A vehicle or vessel comprising the engine of claim 21.

23. A fuel for a combustion engine, consisting of:

(a) from about 95.0% to about 99.9% by weight of a liquid water/alcohol mixture, in which water makes up from about 1% to about 15% by weight of the mixture, (b) from about 0.01% to about 5.0% by weight of an alkyl nitrate, and (c) any remaining balance to 100% by weight of at least one additive selected from the group consisting of additives with preservative functions and additives with detergent functions.

* * * * *